US006440584B1

(12) United States Patent
Nagataki et al.

(10) Patent No.: US 6,440,584 B1
(45) Date of Patent: Aug. 27, 2002

(54) HOT-DIP GALVANIZED STEEL SHEET AND METHOD FOR PRODUCING THE SAME

(75) Inventors: Yasunobu Nagataki; Toshiaki Urabe; Fusato Kitano, all of Fukuyama; Akio Kobayashi; Kunikazu Tomita, both of Kawasaki; Shunsaku Node, Kasaoka; Kozo Harada, Fukuyama; Shogo Sato, Yokohama, all of (JP); Toru Inazumi, Ann Arbor, MI (US)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/953,788

(22) Filed: Sep. 17, 2001

Related U.S. Application Data

(63) Continuation of application No. PCT/JP01/00403, filed on Jan. 23, 2001.

(30) Foreign Application Priority Data

Jan. 24, 2000 (JP) ..... 2000-014921
Jan. 28, 2000 (JP) ..... 2000-019616

(51) Int. Cl.[7] ..... B32B 15/18; C21D 8/02

(52) U.S. Cl. ..... 428/659; 148/533; 148/534; 148/601; 148/651; 148/653; 148/654; 148/661; 148/662; 427/431; 427/433; 427/436; 428/939

(58) Field of Search ..... 428/659, 939; 427/431, 433, 436; 148/533, 534, 601, 651, 653, 654, 661, 662

(56) References Cited

FOREIGN PATENT DOCUMENTS

| | | | | |
|---|---|---|---|---|
| JP | 55024943 A | * | 2/1980 | ..... 148/533 |
| JP | 56-142821 A | | 11/1981 | |
| JP | 5-105960 A | | 4/1993 | |
| JP | 5-306411 A | | 11/1993 | |
| JP | 5-311244 A | | 11/1993 | |
| JP | 7-54051 A | | 2/1995 | |
| JP | 2512640 B2 | | 4/1996 | |
| JP | 9-263883 A | | 10/1997 | |
| JP | 2761095 B2 | | 3/1998 | |
| JP | 2761096 B2 | | 3/1998 | |
| JP | 2862186 B2 | | 12/1998 | |

* cited by examiner

*Primary Examiner*—Robert R. Koehler
(74) *Attorney, Agent, or Firm*—Frishauf, Holtz, Goodman & Chick, P.C.

(57) ABSTRACT

A hot-dip galvanized steel sheet is produced by rough rolling a steel, finish rolling the rough rolled steel at a temperature of Ar3 point or more, coiling the finish rolled steel at a temperature of 700° C. or less, and hot-dip galvanizing the coiled steel at a pre-plating heating temperature of Ac1 to Ac3. A continuous hot-dip galvanizing operation is performed by soaking a pickled strip at a temperature of 750 to 850° C., cooling the soaked strip to a temperature range of 600° C. or less at a cooling rate of 1 to 50° C. per second, hot-dip galvanizing the cooled strip, and cooling the galvanized strip so that the residence time at 400 to 600° C. is within 200 seconds. The steel sheet has a structure consisting essentially of ferrite and martensite.

18 Claims, 3 Drawing Sheets

HOT-DIP GALVANIZED STEEL SHEET AND METHOD FOR PRODUCING THE SAME

This application is a continuation application of International Application PCT/JP01/00403 (not published in English) filed Jan. 23, 2001.

FIELD OF THE INVENTION

The present invention relates to a hot-dip galvanized steel sheet used for automotive structural members, mechanical structural parts, and the like, and a method for producing the same.

DESCRIPTION OF THE RELATED ARTS

In order to improve fuel economy and safety on collision, a high-tensile strength steel sheet has been demanded for vehicle body structural members and suspension members, and a high strength has been required since a long time ago. In addition, in recent years, a hot rolled steel sheet used for vehicle body structural members and suspension members is required to have excellent press formability, especially high ductility, because it is subjected to severe forming consisting mainly of bulging. In this situation, dual-phase structure type hot rolled steel sheets, basically having a microstructure consisting of ferrite and martensite, have been developed.

Furthermore, a steel sheet obtained by hot-dip galvanizing the dual-phase structure type hot rolled steel sheet having both high ductility and corrosion resistance has been demanded, and has been disclosed in Unexamined Japanese Patent Publication No. 56-142821. The steel sheet disclosed in this Publication is characterized in that a steel sheet containing 0.15% or less of C and 1.0 to 2.5% of Mn+Cr by weight % as basic components and the balance of Fe and unavoidable impurities is caused to have a dual-phase structure by a continuous hot-dip galvanizing line (hereinafter, referred to as CGL) on which a pre-plating heating temperature, cooling rate before plating bath, alloying temperature, and cooling rate after alloying are specified in detail.

Specifically, after dual-phases of ferrite phase and austenite phase are formed in the process of pre-plating heating, the austenite phase is changed to a martensite phase by hardening on the CGL.

However, in order to secure hardenability on the CGL line, an alloy element must be added as a steel component, or the line speed of CGL must be increased. The addition of an alloy element increases the cost of steel. Also, for many CGLs, hardenability cannot be secured at a line speed determined from the security of stability of zinc deposition control and the restriction of reaction rate for alloying.

On the other hand, a high-strength hot-dip galvanized steel sheet having a tensile strength exceeding 440 MPa, which has advantages of excellent rust preventing property and high proof stress, has been used widely for construction members, mechanical structural parts, automotive structural parts, and the like. Therefore, a great number of inventions relating to the high-strength hot-dip galvanized steel sheet have been disclosed. In particular, since a need for workability has increased as the application range extends, many inventions relating to a high-strength hot-dip galvanized steel sheet having high workability have been disclosed, for example, in Unexamined Japanese Patent Publication Nos. 5-311244 and 7-54051.

In recent years, while a need for workability of a steel sheet as is manufactured has increased, attention has been paid to the properties of weld portion as a need for a product. This is because as the technology to which the steel sheet is applied expands, a steel sheet is fabricated in a state of including a weld portion as in the case of tailored blank material, or a requirement for high-speed deformation behavior of a structural member including a weld portion becomes stringent.

However, the above-described conventional high-strength a hot-dip galvanized steel sheet has a serious drawback in that a weld heat-affected zone (hereinafter, referred to as HAZ) softens at the time of welding because the main strengthening mechanism generally uses a low-temperature transformation phase such as martensite and bainite obtained by quenching of austenite phase. Such softening phenomenon occurring at the time of welding leads to decreased formability for, for example, a tailored blank material, and also causes a decrease in properties for structural member such as deformation strength, rupture strength, and high-speed deformation strength even when the steel sheet is used for other applications.

SUMMARY OF THE INVENTION

It is an object of the present invention to provide a method for manufacturing a hot-dip galvanized steel sheet with high workability without the use of an expensive alloy element and without being subject to any restriction of CGL facility, and a steel sheet manufactured by the manufacturing method.

To achieve the object, the present invention provides a hot-dip galvanized steel sheet comprising:

a steel sheet containing 0.04 to 0.12% of C, 0.5% or less of Si, 1.0 to 2.0% of Mn, 0.05% or less of P, 0.005% or less of S, 0.05 to 1.0% of Cr, 0.005 to 0.2% of V, 0.1% or less of sol. Al, and 0.01% or less of N by weight %;

the steel sheet having a structure consisting essentially of ferrite and martensite; and a hot-dip galvanizing layer formed on the steel sheet.

The steel sheet may be a hot rolled steel sheet or a cold rolled steel sheet.

Further, the present invention provides a method for producing for a hot-dip galvanized steel sheet, comprising the steps of:

rough rolling a steel containing 0.04 to 0.12% of C, 0.5% or less of Si, 1.0 to 2.0% of Mn, 0.05% or less of P, 0.005% or less of S, 0.05 to 1.0% of Cr, 0.005 to 0.2% of V, 0.1% or less of sol. Al, and 0.01% or less of N by weight %;

finish rolling the rough rolled steel at a temperature not lower than the Ar3 point;

coiling the finish rolled steel at a temperature of 700° C. or less; and hot-dip galvanizing the coiled steel at a pre-plating heating temperature of Ac1 to Ac3.

It is another object of the present invention to provide a new high-strength hot-dip galvanized steel plate having a property such that a change in hardness of HAZ is very small in welding such as laser welding, mush-seam welding, or arc welding, and a method for producing the same.

To achieve the object, the present invention provides a hot-dip galvanized steel sheet comprising:

a steel sheet containing 0.04 to 0.13% of C, 0.5% or less of Si, 1.0 to 2.0% of Mn, 0.05% or less of P, 0.01% or less of S, 0.05% or less of sol. Al, 0.007% or less of N, 0.05 to 0.5% of Mo, and 0.2% or less of Cr by weight %;

the steel sheet having a structure consisting essentially of ferrite having an average grain size of 20 $\mu$m or less and martensite with a volume percentage of 5 to 40%; and a hot-dip galvanizing layer formed on the steel sheet.

The steel sheet may be a hot rolled steel sheet or a cold rolled steel sheet.

Further, the present invention provides a method for producing a hot-dip galvanized steel sheet, comprising the steps of:

rolling a steel containing 0.04 to 0.13% of C, 0.5% or less of Si, 1.0 to 2.0% of Mn, 0.05% or less of P, 0.01% or less of S, 0.05% or less of sol. Al, 0.007% or less of N, 0.05 to 0.5% of Mo, and 0.2% or less of Cr by weight % to manufacture a strip;

pickling the strip; and performing a continuous hot-dip galvanizing, said hot-dip galvanizing comprising the steps of:

soaking the pickled strip at a temperature of 750 to 850° C.;

cooling the soaked strip to a temperature range of 600° C. or less at a cooling rate of 1 to 50° C. per second;

hot-dip galvanizing the cooled strip; and cooling the galvanized strip so that the residence time at 400 to 600° C. is within 200 seconds.

EMBODIMENT FOR CARRYING OUT THE INVENTION

Embodiment 1

Figure 1:
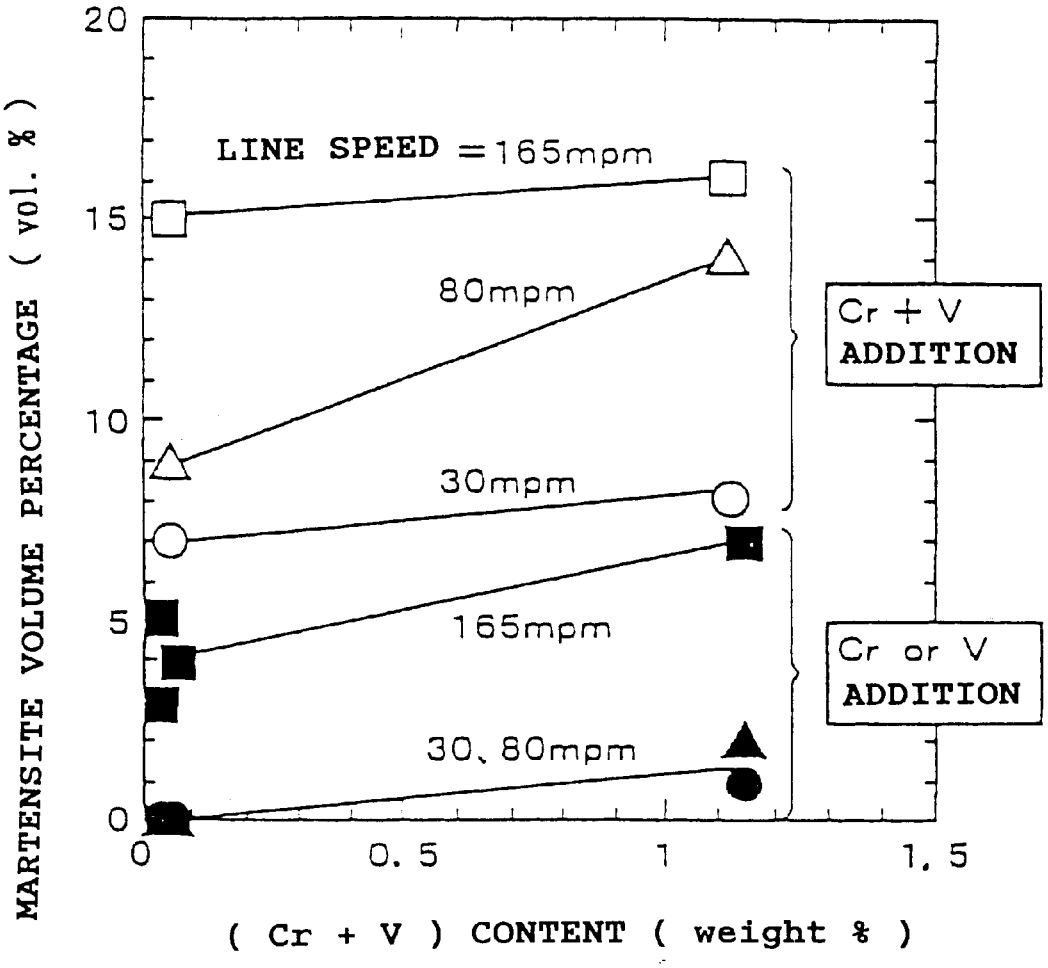
FIG. 1 is a diagram showing an influence of the content of Cr+V in accordance with the present invention on a martensite volume percentage.

The inventors conducted a study on a composition for obtaining a dual-phase structure consisting mainly of ferrite and martensite that provides high hardenability even when the line speed of CGL is relatively low. As the result, we found that proper contents of C, Si, Mn, etc. and combined addition of Cr and V relax the restriction of line speed significantly. The present invention has been made by adding further studies to the above knowledge. The gist of the present invention is as follows:

1. A hot-dip galvanized high tensile strength steel sheet having high workability, characterized by containing 0.04 to 0.12% of C, 0.5% or less of Si, 1.0 to 2.0% of Mn, 0.05% or less of P, 0.005% or less of S, 0.05 to 1.0% of Cr, 0.005 to 0.2% of V, 0.1% or less of sol. Al, and 0.01% or less of N by weight % and further having a structure consisting essentially of ferrite and martensite.
2. A manufacturing method for a hot-dip galvanized high tensile strength steel sheet having high workability, characterized in that a steel containing 0.04 to 0.12% of C, 0.5% or less of Si, 1.0 to 2.0% of Mn, 0.05% or less of P, 0.005% or less of S, 0.05 to 1.0% of Cr, 0.005 to 0.2% of V, 0.1% or less of sol. Al, and 0.01% or less of N by weight % is rough rolled; the rough rolled steel is finish rolled at a temperature higher than the Ar3 point; the finish rolled steel is coiled at a temperature of 700° C. or lower; and the coiled steel is hot-dip galvanized at a pre-plating temperature of Ac1 to Ac3.
3. A manufacturing method for a hot-dip galvanized high tensile strength steel sheet having high workability, characterized in that a steel containing 0.04 to 0.12% of C, 0.5% or less of Si, 1.0 to 2.0% of Mn, 0.05% or less of P, 0.005% or less of S, 0.05 to 1.0% of Cr, 0.005 to 0.2% of V, 0.1% or less of sol. Al, and 0.01% or less of N by weight % is rough rolled; the rough rolled steel is finish rolled at a temperature higher than the Ar3 point; the finish rolled steel is coiled at a temperature of 700° C. or lower; the coiled steel is hot-dip galvanized at a pre-plating temperature of Ac1 to Ac3; and further the galvanized steel is alloyed.

The following is a description of the reason for restricting the components, the reason for restricting the microstructure, the hot rolling conditions, and the hot dip galvanizing conditions of the present invention.

Chemical Composition

C: 0.04% or more and 0.12% or less

C is essential to producing martensite and securing a target strength, and the content thereof of 0.04% or more is needed. On the other hand, if the content of C exceeds 0.12%, the workability decreases. Therefore, the content of C should be 0.04% or more and 0.12% or less.

Si: 0.5% or less

When the content of Si is high, it is difficult to galvanize a steel sheet in hot-dip galvanizing, and the content exceeding 0.5% reduces the adhesion property of plating layer. Therefore, the content of Si should be 015% or less. The content of Si should preferably 0.1% or less.

Mn: 1.0% or more and 2.0% or less

Mn acts advantageously in forming the structure, and is added to improve strength by solid strengthening. To secure necessary strength, 1.0% or more of Mn is added. The content of Mn exceeding 2.0% decreases the workability such as press formability. Therefore, the content of Mn should be 1.0% or more and 2.0% or less.

P: 0.05% or less

P is an impurity element that decreases the weldability and press formability, so that the content is restricted to 0.05% or less. However, the content should preferably be reduced to the utmost in the range allowed in terms of economy. S: 0.005% or less S is an impurity element that produces A-series inclusion together with Mn and decreases the press formability, so that the content is restricted to 0.005% or less. However, the content should preferably be reduced to the utmost in the range allowed in terms of economy.

Cr: 0.05% or more and 1.0% or less

V: 0.005% or more and 0.2% or less

The present invention is characterized by improving the hardenability of steel by the combined addition of Cr and V. In order to significantly relax the restriction of line speed of CGL at which a dual-phase structure type steel sheet can be hardened, 0.05% or more of Cr and 0.005% or more of V are added combinedly. On the other hand, even if these elements are added in large amounts, the effect saturates, and the manufacturing cost increases. Therefore, the contents of Cr and V should be 1.0% or less and 0.2% or less, respectively. When only either Cr or V is added singly, the hardenability cannot be secured sufficiently. The content of Cr should preferably be 0.05 to 0.2%, and the content of V should preferably be 0.002 to 0.1%.

Sol. Al: 0.01% or less

Sol. Al is an essential element for deoxidization. However, if the content exceeds 0.01%, the effect saturates, and Al-series inclusion increases, so that the press formability decreases. Therefore, the content of sol. Al should be 0.10% or less.

N: 0.01% or less

A high content of N decreases the ductility. Therefore, the content of N should be 0.01% or less.

Microstructure

In the present invention, in order to secure necessary strength and satisfactory ductility, the microstructure of steel consists essentially of ferrite and martensite. This structure can contain bainite in the! range such that the operation and effects are not ruined.

Hot Rolling Conditions

Next, the hot rolling conditions will be described. In the present invention, dual-phases of ferrite and austenite are separated in the hot-dip galvanizing process after hot rolling, and hardening is performed. In the hot rolling process, the finishing temperature in finish rolling and coiling temperature are specified so that a desirable structure can be obtained in the hot-dip galvanizing process.

Finishing Temperature: Ar3 Transformation Temperature or Higher

If the finishing temperature is lower than the Ar3 transformation temperature, the rolling of an $\alpha+\gamma$ dual-phase region produces a mixed grain structure, and this problem is not solved after a steel sheet has passed through the CGL, so that the ductility decreases. Therefore, the finishing temperature should be the Ar3 transformation temperature or higher.

Coiling Temperature: 700° C. or lower

If the coiling temperature exceeds 700° C., carbides precipitated in the cooling process are coarsened, so that it takes much time to dissolve, carbides necessary before plating. Therefore, the line speed of CGL must be decreased, which is disadvantageous in hardening the steel sheet and decreases the production efficiency. For, this reason, the coiling temperature should be 700° C. or lower. This tendency is strengthened when a steel sheet is charged in the CGL without being cold rolled.

The hot rolling operation may be performed by a method using a slab manufactured by the ordinary ingot making process or continuous casting process, or may be performed by a method using direct hot rolling process without operation in a heating furnace. The method for hot rolling is not subject to any special restriction. The slab heating temperature may be any temperature such that a weight loss due to scale formation is proper, rough rolling and finish rolling can be performed, and a finish rolling temperature not lower than the Ar3 transformation temperature can be secured. The slab heating temperature is not subject to any special restriction. Also, a semi-finished product may be heated before finish rolling in an atmosphere furnace or by high-frequency heating.

Hot-dip Galvanizing Conditions

As described above, in the present invention, the structure of steel sheet is controlled so as to be a dual-phase structure having necessary strength and workability in the hot-dip galvanizing process. For this purpose, the pre-plating heating condition is specified.

Pre-plating Heating Condition: The Heating Temperature Should be Ac1 Point or Higher and Ac3 Point or Lower, and the Holding Time Should be 5 Seconds to 10 Minutes.

At the stage of pre-plating heating, the steel sheet is heated to a temperature of Ac1 point or higher and Ac3 point or lower to effect tow-phase separation. After plating, or during cooling to a temperature lower than the alloying temperature in the case where alloying is performed after plating, hardening is performed, by which the structure consisting essentially of ferrite and martensite is formed. In order to sufficiently effect dual-phase separation, the holding time may be 5 seconds at the minimum. If the holding time is longer than 5 seconds, there is no problem from the viewpoint of structure control, but if the holding time is too long, the production efficiency decreases. Therefore, the holding time should be within 10 minutes.

On the CGL, precise control of heat cycle is difficult to carry out, and therefore it is usually difficult to control the microstructure so that desired properties can be obtained. In the present invention, however, the combined addition of Cr and V eliminates the need for specially restricting the manufacturing conditions on the CGL, except the specification of pre-plating heating temperature. Even if the cooling rate after plating or during cooling to a temperature lower than the alloying temperature in the case where alloying is performed after plating is as low as 3.5 to 9.3° C. per second, the structure consisting essentially of ferrite and martensite can be obtained.

In the case where the quality of hot-dip galvanization is further stabilized, it is preferable to perform pickling after hot rolling and before hot-dip galvanizing. Also, after hot-dip galvanizing, alloying can be carried out.

EXAMPLE 1

A steel having a chemical composition given in Table 1 was made by a converter, and a slab was formed by continuous casting. The balance not given in Table 1 were Fe and unavoidable impurities. Steel types A and B are steels to which Cr and V are combinedly added, and have a composition in the range of the present invention. Steel type C is a steel to which neither Cr nor V is added, and steel types D to F are steels to which either Cr or V is added, these steel types having a composition outside the range of the present invention.

Then, the slab was finish rolled to a sheet thickness of 2.0 mm at a temperature of 860° C., which is higher than the Ar3 point, and the rolled sheet was coiled at 500° C. After being pickled, the steel sheet was heated to 800° C. and held at that temperature for two minutes on the CGL. Thereafter, the steel sheet was hot-dip galvanized on both surfaces with a coating weight of 45 g/m$^2$, and then was alloyed under the condition of 550° C.×10 sec. At this time, the line speed was increased from the coil head to the coil end for each coil.

From the coil that has passed through the CGL, samples were taken from portions corresponding to line speeds 30, 80 and 165 mpm. Using a JIS No. 5 tensile test piece, the yield strength (YS), tensile strength (TS), yield ratio (YR), and elongation (El) were determined, and also the microstructure was observed. Table 2 gives the results. The cooling rate from the alloying temperature (550° C.) to the Ms point is determined according to the line speed, and is shown in Table 2 as cooling rate.

For examples A1 to B3 of the present invention, which are examples corresponding to the steel type A to which Cr and V are added, a dual-phase structure consisting essentially of ferrite and martensite can be obtained regardless of the line speed of CGL, and satisfactory ductility is provided while necessary strength is secured. On the other hand, comparative examples C1 to F3 are examples corresponding to steel types to which both Cr and V are not combinedly added, having a composition outside the range of the present invention. For the steel types C, D and E, the hardenability is insufficient, and a dual-phase structure consisting essentially of ferrite and martensite cannot be obtained, so that the strength and ductility are insufficient, except for examples D3 and E3 in which the line speed of CGL is 165 mm.

For the steel type F. a structure corresponding to a dual-phase structure is formed at any line speed, and a strength not lower than 590 MPa is secured. However, because this steel type is a type to which Cr is singly added and therefore a large amount of Cr is added, the manufacturing cost is high. The line speed of 165 mpm is close to the upper limit in operation, so that this speed is undesirable because of high percent defective of alloying.

FIG. 1 shows an influence of the content of Cr+V in a steel on a martensite volume percentage of a steel sheet manufactured under the conditions given in Table 2. In the case where Cr and V are combinedly added, a martensite volume percentage of 7% or higher can be obtained regardless of the line speed. On the other hand, in the case where Cr or V is singly added, a martensite volume percentage of 3% or higher can be obtained only at a line speed of 165 mpm. This fact reveals that the combined addition of Cr and V is effective.

TABLE 1

| Classification | Steel type symbol | Chemical composition (wt %) | | | | | | | | |
|---|---|---|---|---|---|---|---|---|---|---|
| | | C | Si | Mn | P | S | Sol. Al | N | Cr | V |
| Present | A | 0.10 | 0.05 | 1.65 | 0.019 | 0.001 | 0.046 | 0.0038 | 0.05 | 0.006 |
| invention | B | 0.07 | 0.04 | 1.57 | 0.009 | 0.004 | 0.033 | 0.0040 | 0.93 | 0.189 |
| Comparative | C | 0.09 | 0.08 | 1.62 | 0.025 | 0.002 | 0.039 | 0.0045 | 0.03 | 0.003 |
| example | D | 0.09 | 0.05 | 1.66 | 0.023 | 0.002 | 0.025 | 0.0048 | 0.06 | 0.003 |
| | E | 0.10 | 0.06 | 1.63 | 0.017 | 0.001 | 0.028 | 0.0039 | 0.02 | 0.007 |
| | F | 0.08 | 0.06 | 1.58 | 0.011 | 0.001 | 0.026 | 0.0044 | 1.14 | 0.002 |

TABLE 2

| Reference character | Steel type symbol | CGL line speed (mpm) | Cooling rate (° C./s) | Tensile property YS (MPa) | TS (MPa) | YR (%) | El (%) | Microstructure | Classification |
|---|---|---|---|---|---|---|---|---|---|
| A1 | A | 30 | 3.5 | 419 | 592 | 71 | 27 | Ferrite + martensite + bainite | Present invention |
| A2 | | 80 | 9.3 | 402 | 597 | 67 | 28 | Ferrite + martensite + bainite | Present invention |
| A3 | | 165 | 19.1 | 391 | 605 | 65 | 27 | Ferrite + martensite | Present invention |
| B1 | B | 30 | 3.5 | 499 | 690 | 72 | 24 | Ferrite + martensite + bainite | Present invention |
| B2 | | 80 | 9.3 | 504 | 744 | 68 | 22 | Ferrite + martensite | Present invention |
| B3 | | 165 | 19.1 | 509 | 769 | 66 | 21 | Ferrite + martensite | Present invention |
| C1 | C | 30 | 3.5 | 425 | 521 | 82 | 30 | Ferrite + fine pearlite | Comparative example |
| C2 | | 80 | 9.3 | 420 | 528 | 80 | 29 | Ferrite + fine pearlite | Comparative example |
| C3 | | 165 | 19.1 | 418 | 543 | 77 | 29 | Ferrite + bainite + fine pearlite | Comparative example |
| D1 | D | 30 | 3.5 | 420 | 519 | 81 | 30 | Ferrite + fine pearlite | Comparative example |
| D2 | | 80 | 9.3 | 407 | 541 | 75 | 29 | Ferrite + bainite + fine pearlite | Comparative example |
| D3 | | 165 | 19.1 | 388 | 590 | 66 | 28 | Ferrite + martensite + bainite | Comparative example |
| E1 | E | 30 | 3.5 | 445 | 565 | 79 | 27 | Ferrite + bainite | Comparative example |
| E2 | | 80 | 9.3 | 438 | 574 | 76 | 27 | Ferrite + bainite | Comparative example |
| E3 | | 165 | 19.1 | 409 | 591 | 69 | 27 | Ferrite + martensite + bainite | Comparative example |
| F1 | F | 30 | 3.5 | 499 | 620 | 80 | 25 | Ferrite + bainite + fine martensite | Comparative example |
| F2 | | 80 | 9.3 | 500 | 651 | 77 | 24 | Ferrite + bainite + fine martensite | Comparative example |
| F3 | | 165 | 19.1 | 493 | 699 | 71 | 22 | Ferrite + martensite + bainite | Comparative example |

EXAMPLE 2

A steel type G to which Cr and V were combinedly added, having a chemical composition in the range of the present invention as given in Table 3 (the balance not given in Table 3 were Fe and unavoidable impurities), was made by a converter, and a slab was formed by continuous casting. Subsequently, the slab was hot rolled under the conditions of a finish temperature of 860° C. higher than the Ar3 point and a coiling temperature (CT) of 400 to 750° C. to produce a strip with a thickness of 2.0 mm. After being pickled, the strip was heated to 800° C. and held at that temperature for two minutes on the CGL. Thereafter, the strip was hot-dip galvanized on both surfaces with a coating weight of 45 g/m$^2$, and then was alloyed under the condition of 550° C.×10 sec.

At this time, the line speed was increased from the coil head to the coil end for each coil. From the coil that has passed through the CGL, samples were taken from portions corresponding to line speeds 30, 80 and 160 mpm. Using a JIS No. 5 tensile test piece, yield strength (YS), tensile strength (TS), yield ratio (YR), and elongation (El) were determined, and also the microstructure was observed. Table 4 gives the results. The cooling rate from the alloying temperature (550° C.) to the Ms point at each portion is determined according to the line speed, and is shown in Table 4 as cooling rate.

For examples 1 to 5 of the present invention, since the coiling temperature is 700° C. or lower, a dual-phase structure consisting of ferrite and martensite can be obtained at all line speeds, so that proper strength and satisfactory ductility are provided. For comparative examples 6 to 8, since the coiling temperature is as high as 750° C., being outside the range of the present invention. When the coiling temperature is as high as 750° C., carbides precipitate as coarse carbides after hot rolling and coiling, and are not dissolved sufficiently even by heating before plating on the CGL. In the case of the comparative examples 7 and 8, carbides partially consisting essentially of cementite in addition to ferrite and martensite are contained, so that a strength-ductility balance is insufficient although the strength is proper. For the comparative example 6, since the line speed is as low as 30 mpm, the dissolution of carbides is sufficient, but the production efficiency is low. Therefore, this comparative example is undesirable.

TABLE 3

| Steel type | Chemical composition (wt %) | | | | | | | | |
|---|---|---|---|---|---|---|---|---|---|
| symbol | C | Si | Mn | P | S | Sol. Al | N | Cr | V |
| G | 0.08 | 0.04 | 1.52 | 0.008 | 0.003 | 0.036 | 0.0046 | 0.45 | 0.08 |

TABLE 4

| Reference character | CT (° C.) | CGL line speed (mpm) | Cooling rate (° C./s) | Tensile property YS (MPa) | TS (MPa) | YR (%) | El (%) | Microstructure | Classification |
|---|---|---|---|---|---|---|---|---|---|
| 1 | 400 | 80 | 9.3 | 435 | 648 | 67 | 25 | Ferrite + martensite | Present invention |
| 2 | 600 | 80 | 9.3 | 413 | 641 | 64 | 26 | Ferrite + martensite | Present invention |
| 3 | 700 | 30 | 3.5 | 416 | 614 | 68 | 28 | Ferrite + martensite | Present invention |
| 4 | 700 | 80 | 9.3 | 422 | 628 | 67 | 27 | Ferrite + martensite | Present invention |
| 5 | 700 | 160 | 18.5 | 437 | 637 | 69 | 26 | Ferrite + martensite | Present invention |
| 6 | 750 | 30 | 3.5 | 509 | 769 | 66 | 21 | Ferrite + martensite + bainite | Comparative example |
| 7 | 750 | 80 | 9.3 | 445 | 602 | 74 | 26 | Ferrite + martensite + carbide | Comparative example |
| 8 | 750 | 160 | 18.5 | 438 | 596 | 73 | 26 | Ferrite + martensite + carbide | Comparative example |

Embodiment 2

Embodiment 2-1 is a hot-dip galvanized steel sheet characterized by containing 0.04 to 0.13% of C, 0.5% or less of Si, 1.0 to 2.0% of Mn, 0.05% or less of P, 0.01% or less (including 0%) of S, 0.05% or less of sol. Al, 0.007% or less (including 0%) of N, 0.05 to 0.5% of Mo, and 0.2% or less (including 0%) of Cr by weight %, the balance consisting essentially of Fe and unavoidable impurities, and having a structure consisting essentially of ferrite having an average grain size of 20 $\mu$m or smaller and martensite with a volume percentage of 5 to 40%.

Embodiment 2-2 is a hot-dip galvanized steel sheet characterized by further containing 0.02 to 0.2% of V in addition of the components of the embodiment 2-1, and having a structure consisting essentially of ferrite having an average grain size of 20 $\mu$m or smaller and martensite with a volume percentage of 5 to 40%.

Embodiment 2-3 for solving the before-mentioned problems is a manufacturing method for a hot-dip galvanized steel sheet described in Embodiment 2-1 or 2-2. This manufacturing method is characterized in that a steel having the components described in Embodiment 2-1 or 2-2 is cast and then hot rolled into a strip; after being pickled, the strip is cold rolled as necessary with a cold rolled reduction of 40% or more; on the succeeding continuous hot-dip galvanizing line, after the strip is soaked at a temperature of 750 to 850° C., it is cooled to a temperature range of 600° C. or lower at a cooling rate of 1 to 50° C. per second, and then is galvanized; as necessary, the strip is further alloyed; and thereafter, the strip is cooled in a state in which the residence time at 400 to 600° C. is within 200 seconds.

The expression of "the balance consisting essentially of Fe and unavoidable impurities" means that a steel sheet containing minute amounts of other elements including unavoidable impurities is embraced in the scope of the present invention unless the effects of the present invention are eliminated. In this description and the accompanying drawings, the percentage % indicating the content of component of steel means weight % unless otherwise specified. Also, "structure consisting essentially of ferrite and martensite with a volume percentage of 5 to 40%" means that a steel sheet containing a structure such as small amounts of cementite, bainite, or retained austenite is embraced in the scope of the present invention.

(Progress in making invention and reason for restricting Mo, V, Cr and structure)

In order to solve the before-mentioned problems, the inventors studied the influence of steel component and structure on a change in strength of weld portion. As the result, we found that by containing a proper amount of Mo in a steel containing basic components of C, Si,Mn, etc. in restricted amounts and providing a structure consisting essentially of ferrite having an average grain size of 20 $\mu$m or smaller and martensite with a volume percentage restricted to 5 to 40%, a high-strength galvanized steel sheet that scarcely decreases the hardness of HAZ can be manufactured. Also, we found that this effect is enhanced by containing a proper amount of V.

It is generally known that if a high temperature of 400 to 800° C. is kept, a low-temperature transformation phase obtained by quenching austenite phase such as martensite and bainite is tempered easily in a short period of time, or carbides are coarsened, by which the strength is, decreased suddenly. The inventors fully studied the influence of steel component and microscopic structure. As the result, we found that the following control is effective in preventing a decrease in strength.

(1) By making martensite having high dislocation density a hard phase and utilizing secondary precipitation strengthening, a decrease in strength of hard phase can be reduced when the temperature rises in a short period of time. For this purpose, it is effective to contain Mo or V. However, if the contents of these elements are high, the hardness of HAZ partially increases as compared with the base metal, which is undesirable in preventing the strength from decreasing. Also, Cr, which is known as a secondary precipitation strengthening element like Mo and V, deposits rapidly when the temperature rises in a short period of time, so that a change in hardness of HAZ increases, so that a high content of Cr is undesirable.

(2) The volume percentage of martensite phase in which a change in hardness is large at the time of welding is restricted to 40% or less, and the balance is made ferrite, by which a change in hardness as a whole can be decreased. However, if the volume percentage of martensite is too low, inversely the secondary precipitation strengthening of martensite phase cannot be utilized effectively for resistance to softening HAZ. Therefore, the lower limit of volume percentage is specified at 5%.

(3) Furthermore, the control of ferrite grain size is also important. The average grain size is specified at 20 $\mu$m or smaller to increase the grain boundary area, by which the deposition of austenite at the grain boundary is promoted when the temperature rises in a short period of time. Thereby, a rise in the Ac3 transformation temperature, at which the hardness of martensite phase decreases most greatly, can be avoided, so that the decrease in hardness of martensite phase can be restrained.

The following is a description of the reason for restricting the content of Mo, V and Cr.

Mo: 0.05% to 0.5%

Mo is an essential element in obtaining the effect of the present invention. As described above, the reason for this is that softening due to tempering of martensite phase caused by a temperature rise at HAZ at the time of welding is restrained by the precipitation of carbides of Mo. Therefore, the content of 0.05%, which achieves the effect, is set as the lower limit. If Mo is contained excessively, the hardness of HAZ increases greatly, and a change in hardness of HAZ increases. For this reason, the upper limit is specified at 0.5%. The content of Mo should preferably 0.15 to 0.4%.

Cr: 0.2% or less (including 0%)

In making the present invention, a study was conducted on an element that seems to be effective for resistance to softening due to tempering of other martensite phases containing Mo as a base, specifically V and Cr. As the result, it was revealed that when the temperature rises in a short period of time as in the case of HAZ at the time of welding, the influence of the kind of element differs, and even a minute amount of Cr contained greatly increases the hardness of HAZ, and thus a content of Cr exceeding 0.2% increases the change in hardness of HAZ. In the present invention, therefore, the content of Cr is restricted to 0.2% or less (including 0%).

V: preferably 0.02 to 0.2%

An element to which attention was paid in this study was V. The combined addition of Mo and V greatly decreased the change in hardness of HAZ. It was thought that the reason for this is that the precipitation strengthening due to V carbide at the time when the temperature of martensite phase rises in a short period of time is not so great, and moreover the temperature at which V carbide precipitates is different from the temperature at which Mo carbide precipitates, sol that in a wide heat history region of HAZ, uniform resistance to softening due to tempering can be provided. The lower limit of V content for achieving such an effect is 0.02%. If V is contained excessively, the hardness of HAZ increases greatly as in the case of Cr, so that the upper limit is specified at 0.2%. The reason for restricting the lower limit of V in the embodiment 2-2 is as described above. Therefore, in the embodiment 2-1, a steel sheet containing 0.02% or less of V is not precluded.

Figure 3A:
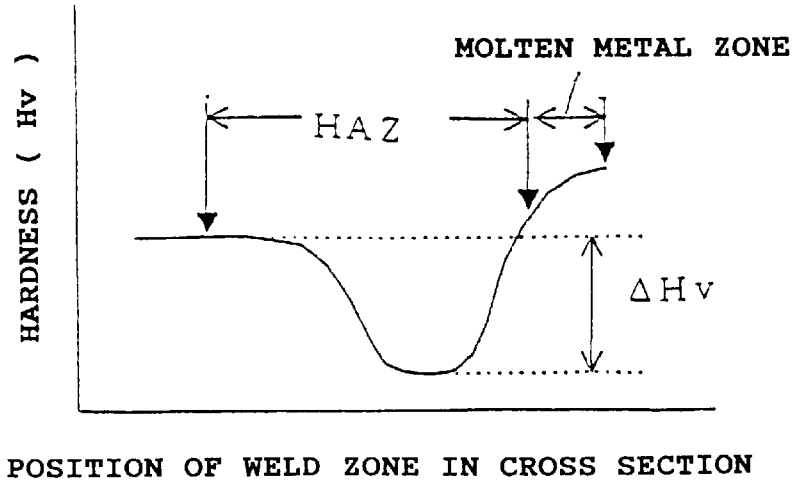
FIGS. 3(*a*), 3(*b*) and 3(*c*) are diagrams schematically showing a change in hardness of HAZ caused by an excessive and insufficient content of Mo, V and Cr.
Figure 3B:
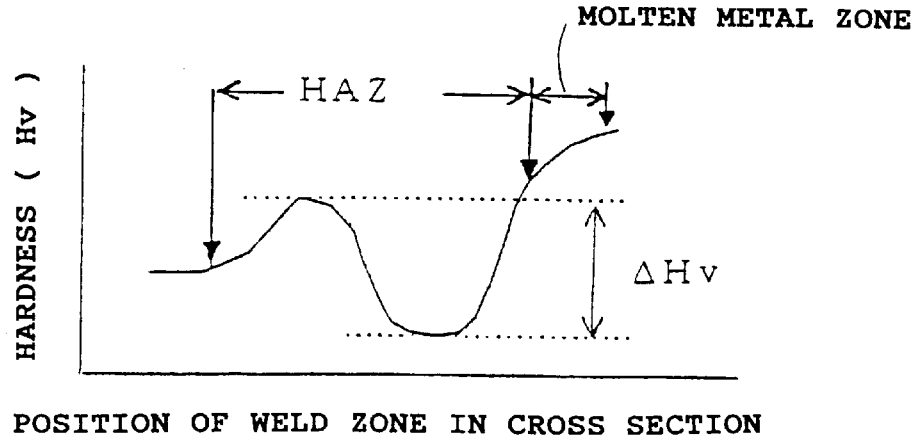
Figure 3C:
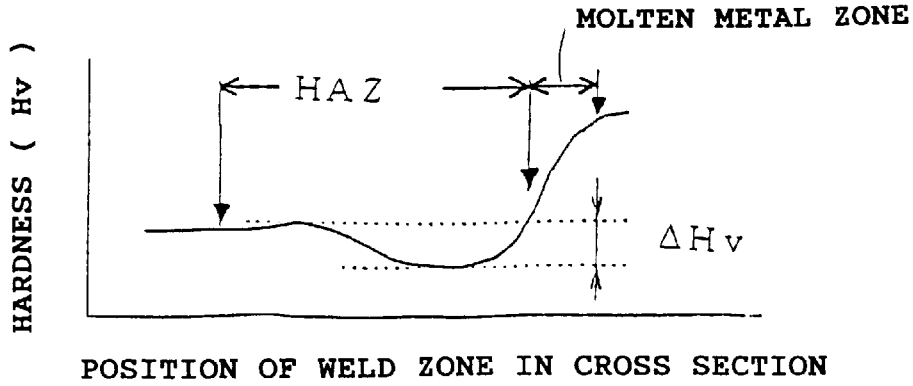

FIGS. 3(*a*) to 3(*c*) schematically show a change in hardness of HAZ caused by an excessive and insufficient content of Mo, V and Cr. FIG. 3(*a*) shows a case where the contents of Mo and V are lower than the proper values, showing that a difference in hardness ΔHv between thee most softened portion of HAZ and the base metal is large. FIG. 3(*b*) shows a case where the contents of Mo, V and Cr exceed the proper values, showing that although the softening degree of HAZ is small, the base metal is also softened, so that the ΔHv increases eventually. FIG. 3(*c*) shows a case where the contents of Mo, V and Cr are within the range of the present invention, showing that the ΔHv is small.

(Reason for restricting other components)

C: 0.04 to 0.13%

C is an essential element in securing a desired strength. However, if the content of C increases, the martensite volume percentage becomes too high, so that the hardness of HAZ increases greatly. Therefore, the lower limit is specified at the minimum value for securing the strength, and the upper limit is specified as described above in order for the martensite volume percentage that greatly decreases the hardness of HAZ not to exceed 40%.

Si: 0.5% or less

Si is an essential element in stably obtaining a dual-phase structure of ferrite and martensite. However, if the content of Si increases, the adhesion property of galvanizing layer and the appearance of surface deteriorate remarkably. Therefore, the upper limit is specified at 0.5%.

Mn: 1.0 to 2.0%

Mn, like C, is an essential element in securing a desired strength. Although a content of 1.0% is necessary to obtain a desired strength as the lower limit, if Mn is contained excessively, the martensite volume percentage increases, and thus the hardness of HAZ decreases greatly. Therefore, the upper limit is specified at 2.0%.

P: 0.05% or less

P, like Si, is an essential element in stably obtaining a dual-phase structure of ferrite and martensite. However, if the content of P increases, the toughness of weld portion decreases. Therefore, the upper limit is specified at 0.05%.

S: 0.01% or less

S is an impurity, so that a high content thereof decreases the toughness of weld portion as in the case of P. Therefore, the upper limit is specified at 0.01%.

Sol. Al: 0.05% or less

The content of Sol. Al contained in the ordinary steel does not ruin the effects of the present invention, and 0.05% or less of sol. Al has no problem . Therefore, the upper limit is specified at 0.05%.

N: 0.007% or less (including 0%)

The content of N contained in the ordinary steel does not ruin the effects of the present invention, and 0.007% or less of N has no problem. Therefore, the upper limit is specified at 0.007%.

For other elements that have not been described above, unless the content thereof is extremely high, the effects of the present invention are not especially ruined. For example, when Nb or Ti is added to provide a higher strength or finer structure of steel, the content thereof within 0.05% has no problem.

(Manufacturing method)

The following is a description of a manufacturing method for the hot-dip galvanized steel sheet in accordance with the present invention.

In order to obtain the steel in accordance with the present invention, the composition of each component must be restricted as described above, and also the structure must be controlled so as to be a structure consisting essentially of ferrite having an average grain size of 20 μm or smaller and martensite with a volume percentage of 5 to 40%.

First, a steel having a predetermined composition is cast, and then is hot rolled into a strip. After being pickled, the strip is further cold rolled with a cold rolled reduction of 40% or more as necessary to prepare a substrate for plating. The conditions for hot rolling are not specified. Unless the hot rolling method is such that, the grain size of hot rolled sheet becomes remarkably large, for example, due to a finish rolling temperature lower than the Ar3 transformation point or a low cooling rate of 10° C./sec or lower after the finish of hot rolling, there does not especially arise any problem. Inversely, a method which decreases the grain size of hot rolled sheet, for example, due to rapid cooling with a high cooling rate of 100 to 300° C./sec performed within one second after the finish of hot rolling or a combination of finish hot rolling with a high reduction with the rapid cooling does not ruin the effects of the present invention. The reason for specifying the reduction at the time of cold rolling at 40% or more is that a reduction lower than 40% is liable to increase the grain size in annealing.

On the succeeding continuous hot-dip galvanizing line, after the strip is soaked at a temperature of 750 to 850° C., it is cooled to a temperature range of 600° C. or lower at a cooling rate of 1 to 50° C. per second, and then is galvanized so that the residence time at 400 to 600° C. is within 200 seconds. As necessary, the strip is further alloyed. A soaking temperature not lower than 750° C. is necessary for stably obtaining the austenite phase. However, if the soaking temperature exceeds 850° C., the grain size increases, so that desired properties cannot be obtained. Therefore, the upper limit is specified at 850° C. Thereafter, the strip is cooled to a temperature range of 600° C. or lower at a cooling rate of 1 to 50° C. per second. The purpose for this is that pearlite is not produced and fine ferrite is precipitated with a desired volume percentage. The lower limit of cooling rate is specified because a cooling rate lower than this value produces pearlite and increases the grain size of ferrite. The upper limit of cooling rate is specified because if a cooling rate is higher than this value, not only ferrite does not precipitate sufficiently but also the martensite volume percentage increases to 40% or more.

The pickled sheet or a cold rolled sheet is cooled to a temperature range of 600° C. or lower and then is galvanized, and further is alloyed as necessary. Finally, the sheet is cooled to room temperature. According to the study conducted by the inventors, it was revealed that in the process of cooling to room temperature, the residence time at 400 to 600° C. has a large influence on the formation of structure. Specifically, if the residence time is long, the precipitation of cementite from austenite is remarkable, and thus not only the volume percentage of martensite phase decreases so that the strength decreases but also the effect of resistance to softening of HAZ due to the precipitation of Mo and V carvide is not achieved. Based on the result of study conducted by the inventors, the upper limit of residence time is specified at 200 seconds.

In the present invention, the structure is specified as a structure consisting essentially of ferrite and martensite with a volume percentage of 5 to 40%. However, even if the structure contains cementite, bainite, or retained austenite with a volume percentage within 5%, the effects of the present invention are not ruined.

Although not mentioned specially, other means such as a slab manufacturing method such as ingot making or continuous casting, continuous hot rolling by means of rough hot rolled bar joint in hot rolling, and temperature rise within 200° C. using an induction heater in the process of hot rolling have no influence on the effects of the present invention.

EXAMPLE

The following is a description of examples of the present invention and comparative examples.

Steels A to X having a chemical composition in the range of the present invention as given in Table 5 and steels a to m of comparative examples having a chemical composition outside the range of the present invention were manufactured by a converter, and slabs were formed by continuous casting. These slabs were hot rolled to form strips at the heating temperature and coiling temperature given in Table 6. After being pickled, some of strips were cold rolled with a draft of 65% to prepare a substrate for plating. Succeedingly, on a continuous hot-dip galvanizing line, a hot-dip galvanized steel sheet or an alloyed hot-dip galvanized steel sheet was manufactured under the conditions given in Table 7. The heat cycle on the continuous hot-dip galvanizing line was set in the preferable range shown in the embodiment 2-3.

Table 7 gives evaluation results for structure, tensile strength, and change in hardness ΔHv of HAZ caused by laser welding of each of these steels. The steel number in Table 7 corresponds to that in Table 6. The laser welding conditions were an output of 5 kw and a welding speed of 2 m/min. The welding speed was especially decreased so that the HAZ is easily softened.

Figure 2:
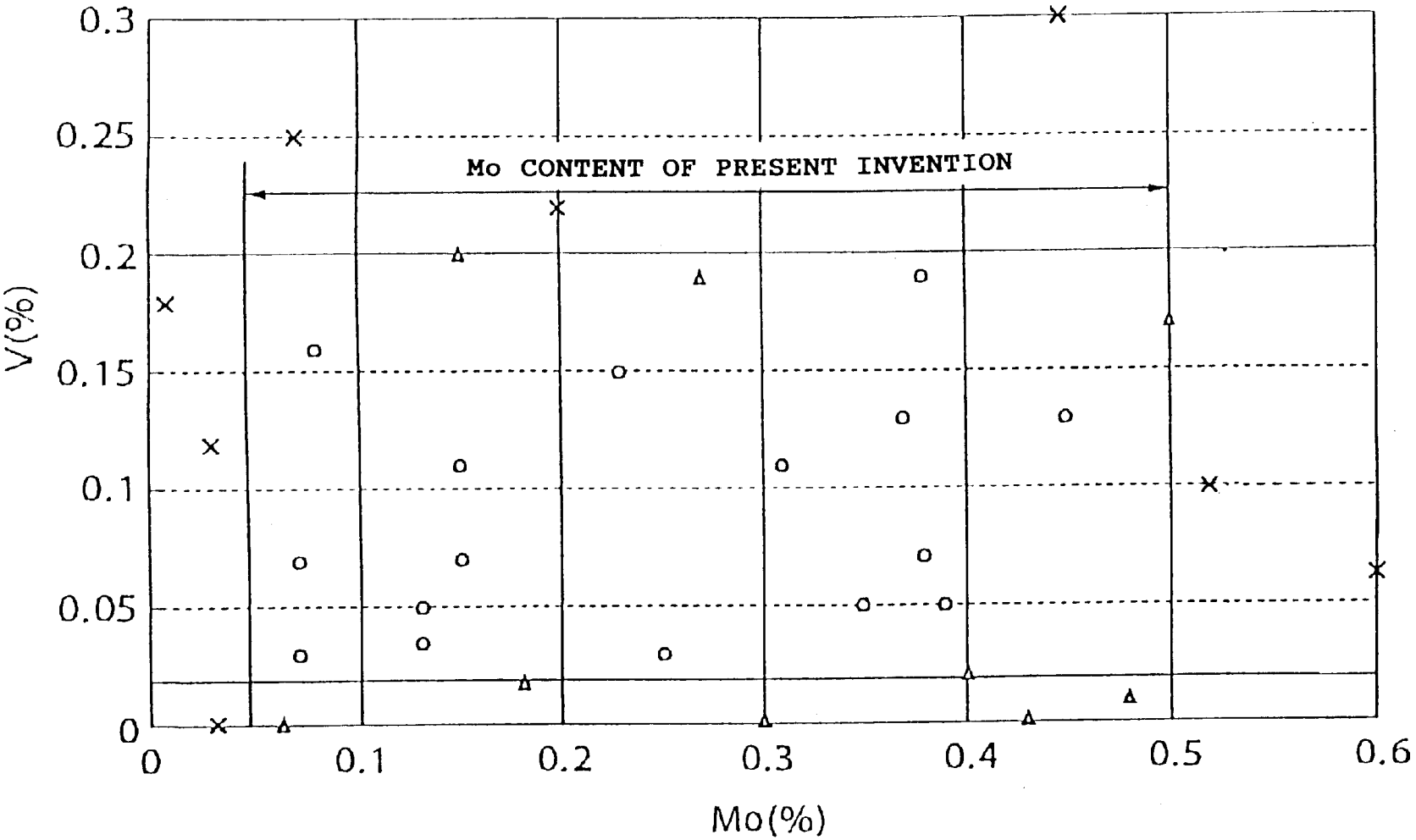
FIG. 2 is a diagram showing a relationship between the content of Mo and V in accordance with the present invention and ΔHv.

FIG. 2 is a diagram in which ΔHv of HAZ of the steel given in Table 7 is summarized by the contents of Mo and V. In this figure, ΔHv is evaluated by three grades of ○ (ΔHv≦10), Δ(10<ΔHv≦20), and (ΔHv>20). As seen from FIG. 2, by setting the contents of Mo and other elements in the range specified by the present invention, high resistance to softening of HAZ of ΔHv≦20 can be obtained. Further, by setting the content of V in the range described in the embodiment 2-2, the resistance of ΔHv≦10 can be obtained. (In FIG. 2, steels in which the content of C is outside the range of the present invention, like steel Nos. 26 and 27 in Table 7, and steels in which the content of Cr is outside the range of the present invention, like steel Nos. 36 to 38 are excluded.)

TABLE 5

| Steel | Composition (wt %) | | | | | | | | | | | TS Calculated value | Remark |
|---|---|---|---|---|---|---|---|---|---|---|---|---|---|
| | C | Si | Mn | P | S | sol.Al | N | Mo | V | Cr | Other | | |
| A | 0.048 | 0.25 | 1.71 | 0.03 | 0.001 | 0.02 | 0.0025 | 0.3 | 0.002 | - | | 626 | P |
| B | 0.05 | 0.2 | 1.4 | 0.025 | 0.0006 | 0.031 | 0.0014 | 0.13 | 0.05 | - | | 542 | P |
| C | 0.049 | 0.36 | 1.9 | 0.014 | 0.001 | 0.014 | 0.0023 | 0.07 | 0.07 | - | | 692 | P |
| D | 0.051 | 0.1 | 1.82 | 0.045 | 0.003 | 0.019 | 0.0025 | 0.43 | 0.002 | - | | 668 | P |
| E | 0.05 | 0.02 | 1.8 | 0.01 | 0.007 | 0.02 | 0.0036 | 0.5 | 0.17 | - | | 805 | P |
| F | 0.06 | 0.01 | 1.65 | 0.026 | 0.003 | 0.021 | 0.0044 | 0.4 | 0.02 | - | | | P |
| G | 0.063 | 0.1 | 1.6 | 0.03 | 0.002 | 0.032 | 0.0036 | 0.07 | 0.03 | - | | | P |
| H | 0.065 | 0.25 | 1.62 | 0.015 | 0.004 | 0.012 | 0.0021 | 0.13 | 0.035 | - | | | P |
| I | 0.064 | 0.23 | 1.35 | 0.032 | 0.002 | 0.024 | 0.002 | 0.15 | 0.11 | - | | | P |
| J | 0.065 | 0.25 | 1.6 | 0.025 | 0.0002 | 0.022 | 0.0028 | 0.31 | 0.11 | - | | | P |
| K | 0.063 | 0.15 | 1.58 | 0.026 | 0.002 | 0.023 | 0.0011 | 0.35 | 0.05 | - | Nb:0.01 | | P |
| L | 0.068 | 0.25 | 1.66 | 0.032 | 0.002 | 0.018 | 0.0048 | 0.23 | 0.15 | - | | | P |
| M | 0.067 | 0.1 | 1.6 | 0.019 | 0.001 | 0.031 | 0.0032 | 0.48 | 0.01 | - | | | P |
| N | 0.064 | 0.48 | 1.63 | 0.011 | 0.002 | 0.026 | 0.0033 | 0.06 | 0.002 | - | | | P |
| O | 0.068 | 0.1 | 1.6 | 0.011 | 0.002 | 0.022 | 0.0015 | 0.25 | 0.03 | - | | | P |
| P | 0.07 | 0.01 | 1.22 | 0.016 | 0.001 | 0.038 | 0.0019 | 0.08 | 0.16 | - | | | P |
| Q | 0.072 | 0.05 | 1.2 | 0.029 | 0.006 | 0.031 | 0.0022 | 0.39 | 0.05 | - | | | P |
| R | 0071 | 0.11 | 1.65 | 0.022 | 0.001 | 0.025 | 0.0019 | 0.45 | 0.13 | - | | | P |

TABLE 5-continued

| | | | | | | | | | | | | | |
|---|---|---|---|---|---|---|---|---|---|---|---|---|---|
| S | 0.07 | 0.01 | 1.2 | 0.016 | 0.001 | 0.024 | 0.0029 | 0.38 | 0.19 | - | | | P |
| T | 0.074 | 0.3 | 1.52 | 0.015 | 0.003 | 0.022 | 0.0021 | 0.27 | 0.19 | - | | | P |
| U | 0.075 | 0.3 | 1.6 | 0.015 | 0.0005 | 0.035 | 0.0036 | 0.15 | 0.2 | - | | | P |
| V | 0.079 | 0.01 | 1.2 | 0.016 | 0.001 | 0.021 | 0.0021 | 0.38 | 0.07 | 0.1 | | | P |
| W | 0.088 | 0.25 | 1.1 | 0.03 | 0.002 | 0.023 | 0.0024 | 0.37 | 0.13 | - | | | P |
| X | 0.096 | 0.29 | 1.6 | 0.032 | 0.001 | 0.024 | 0.0044 | 0.15 | 0.07 | 0.18 | | | P |
| Y | 0.128 | 0.25 | 1.55 | 0.012 | 0.004 | 0.025 | 0.0031 | 0.18 | 0.018 | - | | | P |
| a | 0.136 | 0.15 | 1.5 | 0.021 | 0.003 | 0.03 | 0.0016 | 0.2 | 0.08 | - | | | C |
| b | 0.15 | 0.13 | 1.53 | 0.02 | 0.0006 | 0.036 | 0.0021 | 0.35 | 0.1 | - | | | C |
| c | 0.082 | 0.25 | 1.41 | 0.03 | 0.001 | 0.024 | 0.0022 | 0.01 | 0.18 | - | | | C |
| d | 0.068 | 0.36 | 1.6 | 0.012 | 0.002 | 0.028 | 0.003 | 0.03 | 0.002 | - | | | C |
| e | 0.065 | 0.1 | 1.63 | 0.03 | 0.002 | 0.021 | 0.0019 | 0.03 | 0.12 | - | | | C |
| f | 0.074 | 0.01 | 1.23 | 0.016 | 0.001 | 0.023 | 0.0026 | 0.52 | 0.1 | - | | | C |
| g | 0.075 | 0.3 | 1.6 | 0.026 | 0.005 | 0.026 | 0.0022 | 0.6 | 0.062 | - | | | C |
| h | 0.072 | 0.01 | 1.2 | 0.016 | 0.001 | 0.019 | 0.0026 | 0.2 | 0.22 | - | | | C |
| i | 0.07 | 0.02 | 1.18 | 0.015 | 0.001 | 0.04 | 0.0041 | 0.07 | 0.25 | - | | | C |
| j | 0.075 | 0.3 | 1.6 | 0.015 | 0.007 | 0.025 | 0.0031 | 0.45 | 0.3 | - | | | C |
| k | 0.093 | 0.25 | 1.62 | 0.033 | 0.001 | 0.026 | 0.0029 | 0.23 | 0.07 | 0.23 | | | C |
| l | 0.081 | 0.25 | 1.42 | 0.018 | 0.001 | 0.021 | 0.0021 | 0.18 | 0.05 | 0.3 | | | C |
| m | 0.053 | 0.45 | 1.8 | 0.045 | 0.003 | 0.028 | 0.003 | 0.28 | 0.07 | 0.35 | | | C |

Thick frame indicates that the value is outside the range of present invention.

Minus mark indicates that the content is less than 0.05%.

P: Present invention

C: Comparative example

TABLE 6

| | | Hot rolling condition | | | | | Hot-dip galvanizing condition | | | |
|---|---|---|---|---|---|---|---|---|---|---|
| Steel No. | Steel type | Heating temperature (° C.) | Coiling temperature (° C.) | Reduction (%) | Substrate | Sheet thickness (mm) | Soaking temperature (° C.) | Cooling rate (° C./sec) | Residence time at 400 to 600° C. | Alloying |
| 1 | A | 1220 | 580 | — | Pickled sheet | 2.3 | 800 | 7 | 120 | ○ |
| 2 | B | 1260 | 630 | — | Pickled sheet | 2.3 | 800 | 7 | 100 | x |
| 3 | C | 1230 | 600 | — | Pickled sheet | 2.3 | 780 | 12 | 120 | ○ |
| 4 | D | 1170 | 530 | — | Pickled sheet | 2.3 | 830 | 15 | 180 | ○ |
| 5 | E | 1220 | 620 | 65 | Cold rolled sheet | 1.2 | 800 | 3 | 70 | ○ |
| 6 | F | 1200 | 600 | — | Pickled sheet | 2.3 | 800 | 8 | 180 | ○ |
| 7 | G | 1200 | 580 | — | Pickled sheet | 2.3 | 850 | 20 | 140 | ○ |
| 8 | H | 1200 | 580 | — | Pickled sheet | 2.3 | 850 | 15 | 100 | x |
| 9 | I | 1200 | 580 | — | Pickled sheet | 2.3 | 820 | 10 | 120 | ○ |
| 10 | J | 1200 | 580 | 65 | Cold rolled sheet | 1.2 | 820 | 10 | 120 | ○ |
| 11 | K | 1200 | 580 | — | Pickled sheet | 2.3 | 800 | 2 | 100 | ○ |
| 12 | L | 1270 | 580 | — | Pickled sheet | 2.3 | 800 | 7 | 100 | ○ |
| 13 | M | 1230 | 580 | — | Pickled sheet | 2.3 | 800 | 25 | 140 | ○ |
| 14 | N | 1200 | 580 | — | Pickled sheet | 2.3 | 800 | 20 | 140 | ○ |
| 15 | O | 1200 | 550 | — | Pickled sheet | 2.3 | 820 | 10 | 45 | x |
| 16 | P | 1200 | 550 | — | Pickled sheet | 2.3 | 780 | 10 | 120 | x |
| 17 | Q | 1200 | 620 | — | Pickled sheet | 2.3 | 840 | 5 | 140 | ○ |
| 18 | R | 1200 | 620 | — | Pickled sheet | 2.3 | 800 | 7 | 120 | ○ |
| 19 | S | 1200 | 620 | — | Pickled sheet | 2.3 | 800 | 5 | 120 | ○ |
| 20 | T | 1200 | 580 | — | Pickled sheet | 2.3 | 800 | 28 | 120 | ○ |

TABLE 6-continued

| Steel No. | Steel type | Hot rolling condition: Heating temperature (° C.) | Hot rolling condition: Coiling temperature (° C.) | Hot rolling condition: Reduction (%) | Substrate | Sheet thickness (mm) | Hot-dip galvanizing condition: Soaking temperature (° C.) | Hot-dip galvanizing condition: Cooling rate (° C./sec) | Hot-dip galvanizing condition: Residence time at 400 to 600° C. | Alloying |
|---|---|---|---|---|---|---|---|---|---|---|
| 21 | U | 1200 | 580 | 65 | Cold rolled sheet | 1.2 | 800 | 10 | 30 | x |
| 22 | V | 1200 | 580 | — | Pickled sheet | 2.3 | 800 | 13 | 120 | ○ |
| 23 | W | 1200 | 580 | — | Pickled sheet | 2.3 | 750 | 9 | 120 | ○ |
| 24 | X | 1280 | 600 | 65 | Cold rolled sheet | 1.2 | 780 | 5 | 120 | ○ |
| 25 | Y | 1200 | 600 | — | Pickled sheet | 2.3 | 800 | 27 | 120 | ○ |
| 26 | a | 1200 | 600 | — | Pickled sheet | 2.3 | 800 | 10 | 120 | ○ |
| 27 | b | 1200 | 600 | — | Pickled sheet | 2.3 | 800 | 10 | 120 | ○ |
| 28 | c | 1200 | 600 | — | Pickled sheet | 2.3 | 800 | 10 | 120 | ○ |
| 29 | d | 1200 | 600 | — | Pickled sheet | 2.3 | 800 | 10 | 120 | ○ |
| 30 | e | 1200 | 600 | — | Pickled sheet | 2.3 | 800 | 10 | 120 | ○ |
| 31 | f | 1200 | 600 | — | Pickled sheet | 2.3 | 800 | 10 | 120 | ○ |
| 32 | g | 1200 | 600 | — | Pickled sheet | 2.3 | 800 | 10 | 120 | ○ |
| 33 | h | 1200 | 600 | — | Pickled sheet | 2.3 | 800 | 10 | 120 | ○ |
| 34 | i | 1200 | 600 | — | Pickled sheet | 2.3 | 800 | 10 | 120 | ○ |
| 35 | j | 1200 | 600 | — | Pickled sheet | 2.3 | 800 | 10 | 120 | ○ |
| 36 | k | 1200 | 600 | — | Pickled sheet | 2.3 | 800 | 10 | 120 | ○ |
| 37 | l | 1200 | 600 | — | Pickled sheet | 2.3 | 800 | 10 | 120 | ○ |
| 38 | m | 1200 | 600 | — | Pickled sheet | 2.3 | 800 | 10 | 120 | ○ |

TABLE 7

| Steel No. | Structure: Ferrite grain size (μm) | Structure: Martensite volume percentage (%) | Property: TS (MPa) | Property: Change in hardness of HAZ (ΔHv) | Symbol | Classification |
|---|---|---|---|---|---|---|
| 1 | 13 | 10 | 626 | 17 | △ | Present invention |
| 2 | 12 | 8 | 542 | 8 | ○ | Present invention |
| 3 | 8 | 12 | 692 | 10 | ○ | Present invention |
| 4 | 10 | 13 | 668 | 15 | △ | Present invention |
| 5 | 18 | 12 | 690 | 12 | △ | Present invention |
| 6 | 9 | 9 | 638 | 12 | △ | Present invention |
| 7 | 7 | 15 | 572 | 9 | ○ | Present invention |
| 8 | 10 | 14 | 624 | 5 | ○ | Present invention |
| 9 | 11 | 13 | 619 | 8 | ○ | Present invention |
| 10 | 12 | 12 | 726 | 8 | ○ | Present invention |
| 11 | 10 | 12 | 661 | 6 | ○ | Present invention |
| 12 | 9 | 15 | 761 | 9 | ○ | Present invention |
| 13 | 8 | 17 | 666 | 13 | △ | Present invention |
| 14 | 11 | 16 | 616 | 19 | △ | Present invention |
| 15 | 9 | 17 | 627 | 9 | ○ | Present invention |
| 16 | 13 | 19 | 587 | 10 | ○ | Present invention |
| 17 | 19 | 20 | 579 | 7 | ○ | Present invention |
| 18 | 9 | 18 | 781 | 9 | ○ | Present invention |

TABLE 7-continued

| | | | | | | |
|---|---|---|---|---|---|---|
| 19 | 11 | 18 | 682 | 10 | ○ | Present invention |
| 20 | 6 | 21 | 790 | 12 | △ | Present invention |
| 21 | 9 | 20 | 790 | 11 | △ | Present invention |
| 22 | 8 | 20 | 602 | 6 | ○ | Present invention |
| 23 | 10 | 25 | 677 | 8 | ○ | Present invention |
| 24 | 11 | 28 | 725 | 8 | ○ | Present invention |
| 25 | 5 | 37 | 796 | 17 | △ | Present invention |
| 26 | 10 | 43 | 782 | 28 | × | Comparative example |
| 27 | 9 | 45 | 810 | 36 | × | Comparative example |
| 28 | 11 | 22 | 698 | 23 | × | Comparative example |
| 29 | 9 | 14 | 591 | 31 | × | Comparative example |
| 30 | 8 | 13 | 648 | 25 | × | Comparative example |
| 31 | 10 | 19 | 659 | 29 | × | Comparative example |
| 32 | 8 | 16 | 750 | 33 | × | Comparative example |
| 33 | 11 | 17 | 666 | 26 | × | Comparative example |
| 34 | 13 | 18 | 651 | 31 | × | Comparative example |
| 35 | 7 | 22 | 730 | 33 | × | Comparative example |
| 36 | 8 | 25 | 737 | 38 | × | Comparative example |
| 37 | 10 | 20 | 633 | 37 | × | Comparative example |
| 38 | 8 | 12 | 570 | 38 | × | Comparative example |

Thick frame indicates that the value is outside tne range of present invention.
P: Present invention
C: Comparative example Table 8 gives the results of studies on a change in property, which were conducted by changing the heat cycle especially on a continuous hot-dip galvanizing line for steel H of an example of the present inventions Since the soaking temperature is improper for steel Nos. 1 and 5, the cooling rate is improper for steel Nos. 6 and 11, and the residence time at 400 to 600° C. is too long for steel No. 16, the structure specified in the present invention is not obtained, and desired resistance to softening of HAZ is not obtained. Contrarily, for the steel of the present invention manufactured under the manufacturing conditions described in Embodiment 2-3, the structure described in Embodiment 2-1 is obtained, and high resistance to softening of HAZ of $\Delta Hv \leqq 20$ is obtained.

TABLE 8

| Steel No. | Steel type | Hot rolling condition | | Reduction (%) | Substrate | Sheet thickness (mm) | Hot-dip galvanizing condition | | | | Structure | | Property | | Classification |
|---|---|---|---|---|---|---|---|---|---|---|---|---|---|---|---|
| | | Heating temperature (° C.) | Colling temperature (° C.) | | | | Soaking temperature (° C.) | Cooling rate (° C./sec) | Residence time at 400 to 600° C. | Alloying | Ferrite grain size (μm) | Martensite volume percentage (%) | TS (MPa) | Change in hardness of HAZ (ΔHv) | |
| 1 | H | 1220 | 580 | - | Pickled sheet | 2.3 | 730 | 10 | 120 | ○ | 12 | 3 | 571 | 28 | C |
| 2 | H | 1220 | 580 | - | Pickled sheet | 2.3 | 750 | 10 | 120 | ○ | 10 | 18 | 615 | 13 | P |
| 3 | H | 1220 | 580 | - | Pickled sheet | 2.3 | 800 | 10 | 120 | ○ | 10 | 17 | 610 | 10 | P |
| 4 | H | 1220 | 580 | - | Pickled sheet | 2.3 | 850 | 10 | 120 | ○ | 18 | 18 | 600 | 8 | P |
| 5 | H | 1220 | 580 | - | Pickled sheet | 2.3 | 870 | 10 | 120 | ○ | 23 | 20 | 590 | 23 | P |
| 6 | H | 1220 | 580 | - | Pickled sheet | 2.3 | 800 | 0.5 | 120 | ○ | 25 | 10 | 570 | 30 | C |
| 7 | H | 1220 | 580 | - | Pickled sheet | 2.3 | 800 | 2 | 120 | ○ | 13 | 18 | 605 | 10 | C |
| 8 | H | 1220 | 580 | - | Pickled sheet | 2.3 | 800 | 5 | 120 | ○ | 10 | 16 | 607 | 9 | P |
| 9 | H | 1220 | 580 | - | Pickled sheet | 2.3 | 800 | 20 | 120 | ○ | 8 | 17 | 612 | 8 | P |
| 10 | H | 1220 | 580 | - | Pickled sheet | 2.3 | 800 | 50 | 120 | ○ | 6 | 37 | 625 | 16 | P |
| 11 | H | 1220 | 580 | - | Pickled sheet | 2.3 | 800 | 60 | 120 | × | 7 | 46 | 670 | 22 | C |
| 12 | H | 1220 | 580 | - | Pickled sheet | 2.3 | 800 | 10 | 40 | ○ | 8 | 22 | 605 | 15 | P |
| 13 | H | 1220 | 580 | - | Pickled sheet | 2.3 | 800 | 10 | 90 | ○ | 9 | 18 | 612 | 9 | P |
| 14 | H | 1220 | 580 | - | Pickled sheet | 2.3 | 800 | 10 | 160 | ○ | 10 | 18 | 608 | 7 | P |
| 15 | H | 1220 | 580 | - | Pickled sheet | 2.3 | 800 | 10 | 190 | ○ | 12 | 17 | 590 | 13 | P |
| 16 | H | 1220 | 580 | - | Pickled sheet | 2.3 | 800 | 10 | 220 | ○ | 15 | 4 * | 563 | 31 | C |

* mark indicates that much cementite deposits.
P: Present invention
C: Comparative example

What is claimed is:

1. A hot-dip galvanized steel sheet comprising:

a steel sheet containing 0.04 to 0.12% of C, 0.5% or less of Si, 1.0 to 2.0% of Mn, 0.05% or less of P, 0.005% or less of S, 0.05 to 1.0% of Cr, 0.005 to 0.2% of V, 0.1% or less of sol. Al, and 0.01% or less of N by weight %;

said steel sheet having a structure consisting essentially of ferrite and martensite; and a hot-dip galvanizing layer formed on the steel sheet.

2. The hot-dip galvanized steel sheet according to claim 1, wherein said steel sheet is a hot rolled steel sheet.

3. The hot-dip galvanized steel sheet according to claim 1, wherein said steel sheet is a cold rolled steel sheet.

4. The hot-dip galvanized steel sheet according to claim 1, wherein said steel sheet has a martensite volume percentage of at least 7%.

5. The hot-dip galvanized steel sheet according to claim 1, wherein the content of Si is 0.1% or less.

6. The hot-dip galvanized steel sheet according to claim 1, wherein the content of Cr is 0.05 to 0.2%.

7. The hot-dip galvanized steel sheet according to claim 1, wherein the content of V is 0.02 to 0.1%.

8. A method for producing a hot-dip galvanized steel sheet, comprising the steps of:

rough rolling a steel containing 0.04 to 0.12% of C, 0.5% or less of Si, 1.0 to 2.0% of Mn, 0.05% or less of P, 0.005% or less of S, 0.05 to 1.0% of Cr, 0.005 to 0.2% of V, 0.1% or less of sol. Al, and 0.01% or less of N by weight %;

finish rolling the rough rolled steel at a temperature of the Ar3 point or more;

coiling the finish rolled steel at a temperature of 700° C. or less; and hot-dip galvanizing the coiled steel at a pre-plating heating temperature of Ac1 to Ac3.

9. The method according to claim 8, further comprising the step of alloying the hot-dip galvanized steel.

10. The method according to claim 8, wherein the content of Si is 0.1% or less.

11. A hot-dip galvanized steel sheet comprising:

a steel sheet containing 0.04 to 0.13% of C, 0.5% or less of Si, 1.0 to 2.0% of Mn, 0.05% or less of P, 0.01% or less of S, 0.05% or less of sol. Al, 0.007% or less of N, 0.05 to 0.5% of Mo, and 0.2% or less of Cr by weight %;

said steel sheet having a structure consisting essentially of ferrite having an average grain size of 20 $\mu$m or less and martensite with a volume percentage of 5 to 40%; and a hot-dip galvanizing layer formed on the steel sheet.

12. The hot-dip galvanized steel sheet according to claim 11, wherein said steel sheet further contains 0.02 to 0.2% of V.

13. The hot-dip galvanized steel sheet according to claim 11, wherein said steel sheet is a hot rolled steel sheet.

14. The hot-dip galvanized steel sheet according to claim 11, wherein said steel sheet is a cold rolled steel sheet.

15. A method for producing a hot-dip galvanized steel sheet, comprising the steps of:

rolling a steel containing 0.04 to 0.13% of C, 0.5% or less of Si, 1.0 to 2.0% of Mn, 0.05% or less of P, 0.01% or less of S, 0.05% or less of sol. Al, 0.007% or less of N, 0.05 to 0.5% of Mo, and 0.2% or less of Cr by weight % to produce a strip;

pickling said strip; and performing a continuous hot-dip galvanizing, said continuous hot-dip galvanizing comprising the steps of:

soaking the pickled strip at a temperature of 750 to 850° C.;

cooling the soaked strip to a temperature range of 600° C. or lower at a cooling rate of 1 to 50° C. per second;

hot-dip galvanizing the cooled strip; and cooling the galvanized strip so that the residence time at 400 to 600° C. is within 200 seconds.

16. The method according to claim 15, wherein said strip is a hot rolled strip.

17. The method according to claim 15, wherein said strip is a cold rolled strip obtained by cold rolling the hot rolled strip with a cold rolled reduction of 40% or more.

18. The method according to claim 15, further comprising the step of alloying said galvanized strip after the step of hot-dip galvanizing.

* * * * *